United States Patent [19]

King et al.

[11] Patent Number: 4,823,003

[45] Date of Patent: Apr. 18, 1989

[54] CHARGED PARTICLE OPTICAL SYSTEMS HAVING THEREIN MEANS FOR CORRECTING ABERRATIONS

[76] Inventors: George C. King, 6 Hollingford Place, Knutsford, Cheshire WA16 9DP; Frank H. Read, Hardingland Farm, Maclesfield Forrest, Cheshire SK10 0ND, both of England

[21] Appl. No.: 73,754

[22] Filed: Jul. 13, 1987

[30] Foreign Application Priority Data

Jul. 16, 1986 [GB] United Kingdom ..... 8617384

[51] Int. Cl.[4] ..... H01J 40/00; H01J 47/00

[52] U.S. Cl. ..... 250/305; 250/396 R

[58] Field of Search ..... 250/281, 297, 298, 305, 250/396 R, 396 ML; 313/361.1, 414

[56] References Cited

U.S. PATENT DOCUMENTS

| | | | |
|---|---|---|---|
| 2,452,919 | 11/1948 | Gabor | 250/396 R |
| 3,407,323 | 10/1968 | Hand | 250/396 R |
| 3,735,128 | 5/1973 | Palmberg | 250/305 |
| 4,002,912 | 1/1977 | Johnson | 250/396 R |
| 4,150,319 | 4/1979 | Nowak et al. . | |
| 4,672,261 | 6/1987 | Shirai et al. | 313/414 |

FOREIGN PATENT DOCUMENTS

| | | |
|---|---|---|
| 0087196 | 8/1983 | European Pat. Off. . |
| 879878 | 4/1953 | Fed. Rep. of Germany . |
| 1136021 | 9/1962 | Fed. Rep. of Germany . |
| 758306 | 7/1981 | U.S.S.R. . |
| 723861 | 2/1955 | United Kingdom . |
| 724071 | 2/1955 | United Kingdom . |
| 779564 | 7/1957 | United Kingdom . |
| 1101153 | 7/1968 | United Kingdom . |

*Primary Examiner*—Bruce C. Anderson

*Attorney, Agent, or Firm*—Leydig, Voit & Mayer

[57] ABSTRACT

A charged particle optical system, e.g. an energy or mass analyzer or a lens system, has a plurality of corrector electrodes (20 to 23) spaced apart across a particle beam passing from a monoenergetic source (4) to a focus (6) and dividing the beam into individual portions with central trajectories (30,31,32) the connector electrodes being electrically biassed to deflect the particles of the beam so as to reduce the aberration caused by portions with central trajectories intersecting the optical axis at different distances from the desired focus.

16 Claims, 10 Drawing Sheets

CHARGED PARTICLE OPTICAL SYSTEMS HAVING THEREIN MEANS FOR CORRECTING ABERRATIONS

FIELD OF THE INVENTION

This invention relates to charged particle optical systems, having therein means for correcting aberrations and in particular to the correction of one form of aberration, which can be referred to as 'aperture defect', in an energy analyzer, mass analyzer, a charged particle lens system or any other charged particle optical system which suffers from such aberration. Although the invention will be considered with particular reference to electrons, it also applied to other charged particles.

BACKGROUND TO THE INVENTION

In electron optics various devices are available for the focusing, deflection, and mass and energy analysis of electrons and ions and these devices have been comprehensively described in various works on the subject of electron optics. Nearly all electron optical devices suffer from aberrations and the most serious of these aberrations is usually what has been called aperture defect. Aperture defect is present when electrons leaving a source on the optical axis of a device, at a relatively large angle to the axis, (the so-called peripheral trajectories) re-cross the axis or come to a focus on the axis at shorter or a longer distance from the source than those leaving the source at a small angle to the said axis (the so-called paraxial trajectories). The angles generally encountered in practical electron optics are generally significantly smaller than those used in visible light optics. For instance 10° is a large angle in electron optical terms whereas 45° is common in light optics. The aperture defect in an axially symmetrical electron lens is generally known as spherical aberration. In a lens of planar symmetry it has been called "linear aberration coefficient". Each type of deflection energy analyzer suffers from a similar defect even though it may have a curved optical axis, defined as the path of the median optical ray. Other types of aberration also exist in charged particle optical systems, but in the following the word aberration will be taken to represent the aperture defect.

The effect of the aberration in an energy analyzer is to limit the energy resolution of the device whereas in lenses the aberration limits the image quality or the smallness of image.

Various means for reducing the spherical aberration of an axially symmetric electron lens have been proposed and successfully used (see for instance the article by A. Septier entitled 'The Struggle to Overcome Spherical Aberration in Electron Optics' in 'Advances in Optical and Electron Microscopy' 1966 Vol I, p204 et seq). However, particularly in the case of cylindrical and hemispherical (or other section of a sphere) electrostatic energy analysers, the problem of reducing the aberration still remains.

DESCRIPTION OF THE INVENTION

According to the present invention there is provided a charged particle optical system, such for example as an energy analyzer, a mass analyzer or a lens system the system having means for defining the path of a beam of substantially monoenergetic particles from a source on the optical axis of the system to a desired image position on the same axis, the system being subject to the aberration in which the trajectories of the particles emitted from the source at relatively large angles to the axis are brought to a focus on the same axis either nearer to or further from the source than the trajectories of particles emitted at relatively small angles to the axis, the system having a plurality of electrically-insulated corrector electrodes disposed in spaced-apart relationship across the said path of the beam thereby dividing the beam into separate portions and which electrodes, when suitably biassed, so deflect the beam portions as to cause the beam portions to intersect the optical axis at, or closer to, the desired image position, thereby reducing the aberration.

In the present invention the correctors can be mounted in a region of field or in a region substantially free of field within the charged particle optical device. The supports for the correctors can be made to insulating or semi-conducting or conducting material.

The present invention also provides a method of sharpening the focus of a beam of monoenergetic charged particles emitted from a source in an energy analyzer, a mass analyzer or a lens system and brought to a focus on the optical axis of the system, the system being subject to the aberration in which the trajectories of the particles emitted from the source at relatively large angles to the axis are brought to a focus on the same axis either nearer to or further from the source than the trajectories of particles emitted at relatively small angles to the axis, the method comprising passing the beam through a plurality of electrodes spaced apart from one another transversely of the beam to split the beam into a plurality of transversely - spaced beam portions and applying different potentials, to respective electrodes to cause corresponding beam portions to be deflected in a sense to cause the beam portions to intersect the optical axis closer to the desired focus, thereby reducing the aberration.

BRIEF DESCRIPTION OF THE DRAWINGS

In the drawings:

FIG. 24*a* is a sectional view of an axially symmetric magnetic electron lens, without a correcting system, and illustrating the path of electrons from a monoenergetic point source to a focus, whereas

DESCRIPTION OF THE PREFERRED EMBODIMENT

Figure 1:
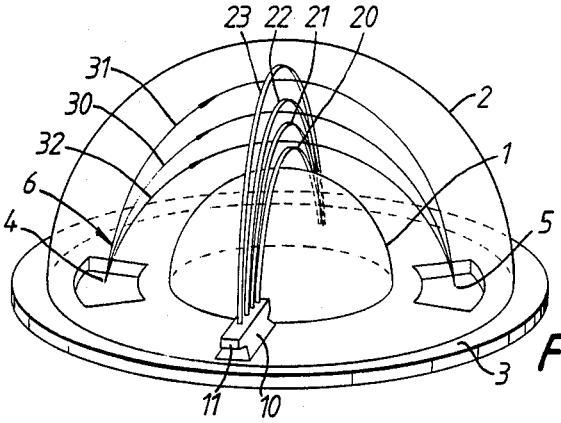
FIG. 1 is a perspective view, part sectioned, of an electrostatic hemispherical energy analyser provided with aberration corrector strips.

In the embodiment of the invention shown in FIG. 1 the basic electrostatic hemispherical analyzer comprises an inner conducting hemisphere 1, and a concentric outer conducting hemisphere 2. The two hemispheres are insulated from each other and are mounted on a fringe field correcting plate 3. A beam of monoenergetic charged particles, from a point source 4, is deflected through 180° by means of suitable potentials applied to the hemispheres 1 and 2. The source 4 is located at the entrance to the hemisphere and particles are brought to focus 5, on the diammetrically opposite side of the hemisphere, at the exit of the hemispheres. Semi-circular corrector strips 20,21,22,23 (sometimes referred to herein as corrector electrodes or correctors) are mounted across the analyzer between the hemispheres 1,2 and with their length at right angles to, and their width in the same direction as, the optical axis of the charged particle beam 6, the strips being located to intersect different parts of the charged particle beam. The strips are maintained at different potentials which are generally different to those applied to the hemispheres 1,2.

Figure 2:
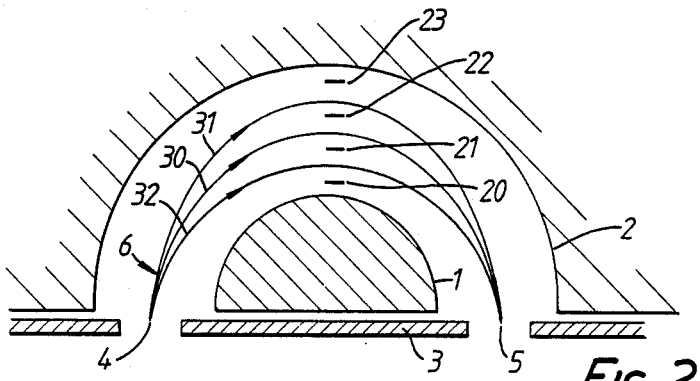
FIG. 2 is a cross-section containing the optical axis of the analyzer of FIG. 1.

Although only four corrector strips are shown, more can be used, for finer corrections. The strips, 20,21,22,23 are mounted on a supporting structure 10,11,12 covered by a guard shield 13 which minimises any distortion in the field due to the supporting structure in the region of the hemisphere through which the charged particle beam 6 passes. The charged particle beam can, in a four strip corrector system, be considered as being split into three main portions 30,31,32 as it passes through the correctors 20,21,22,23, as seen in FIG. 2.

Since the corrector strips 20,21,22,23 are at right angles to the plane of the curved optical axis they present only a narrow cross-section both in this plane and also to the electron beam. The effect of the corrector strips, when suitably biassed, is to slightly deflect the different beam portions by different amounts so as to cause a reduction in the aberration and so bring the electrons to a sharper focus. Preferably one of the beam portions will be disposed equally on opposite sides of the optical axis and will be virtually free of aberration. Consequently all of the corrector electrodes will be spaced from the optical axis.

Figure 3:
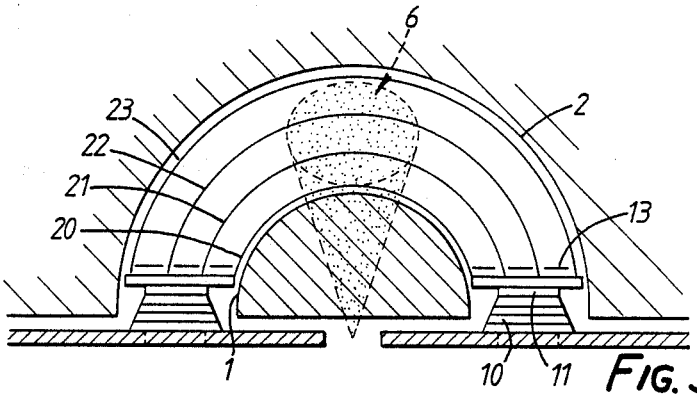
FIG. 3 is a cross-section through the analyzer of FIGS. 1 and 2 in a section plane normal to that of FIG. 2.

FIG. 3 shows the envelope of the charged particle beam 6, at right angles to the plane of the figure. The full extent of the corrector strips, 20,21,22,23 are shown and the supporting structure 10,11,12 and shield 13, is shown in relationship to the inner and outer hemispheres 1,2.

Figure 4:
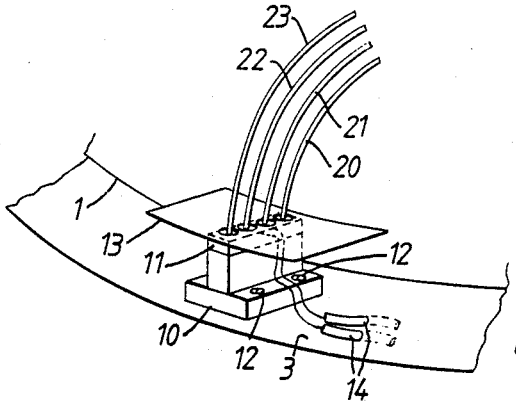
FIG. 4 is a perspective view on an enlarged scale of the support structure for the corrector strips.

The supporting structure can be of the form shown in FIG. 4 where a metal block 10 is attached to the fringe field correcting plates. The block 10 has a slotted insulator 11 fastened to it and the slots in the insulator locate and hold the corrector strips 21,21,22,23. Above the insulator is the shield 13 which contains apertures through which the corrector strips pass. The shield 13 is maintained at a potential which will minimise the distortion of the field between the hemispheres 1,2. The corrector strips are at different potentials from the hemispheres and from the fringe field plate hence the necessity for the insulator 11. The whole structure is attached to the fringe field plate by suitable screws, 12. The potentials are applied to the corrector strips and the shield 13 by means of suitably shielded and insulated wires 14 which pass through the vacuum system from a suitable external lead. Alternatively the component 11 can be constructed from a partially conducting or a semiconducting material, such as silicon, or partially conducting ceramic or an insulator coated with a layer of graphite.

FIGS. 5, 6, 7, 8, 9 and 10 illustrate the function of the corrector strips.

Figure 5:
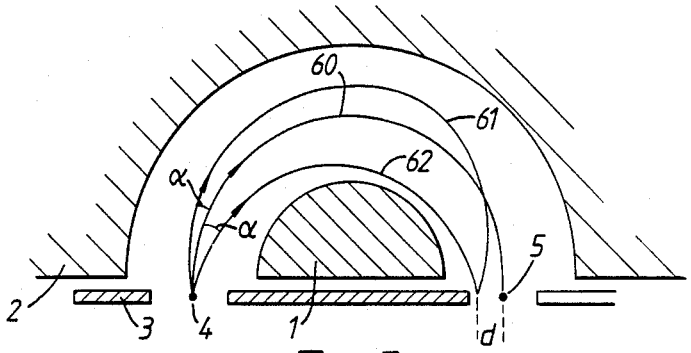
FIG. 5 is a diagram representing the aperture defect in a normal uncorrected electrostatic hemispherical energy analyzer.

FIG. 5 shows the electron trajectories in an uncorrected electrostatic hemispherical energy analyzer from a point source of monoenergetic electrons ejected at different angles at the entrance to the hemispheres. The central trajectory 60 when a suitable potential difference is applied between the hemispheres 1,2 follows the mean radius between the hemispheres 1,2, and constitutes the optical axis.

The outer trajectory 61, which initially travels nearer to the outer hemisphere 2, eventually reaches a point at the exit which is nearer the inner hemisphere 1. The inner trajectory 62 follows a course adjacent to the inner hemisphere 1 and, at the exit, the path is very close to that followed by the outer trajectory 61. The spread d between the central trajectory 60 and the other two trajectories 61,62 gives rise to an energy resolution $E_b$ given by the expression:

$$E_b/E = C_w \frac{W}{R} + C_\alpha \alpha^2 \quad (1)$$

for a monochromatic point source,
where:

$E_b$=base width resolution (eV)
E=mean energy of beam (eV)
$C_w=1$
$C_\alpha=2$
$W=W_1+W_2$=mean slit width
R=radius of the central trajectory
$\alpha$=the semi-angle subtended by the beam at the source.

Figure 6:
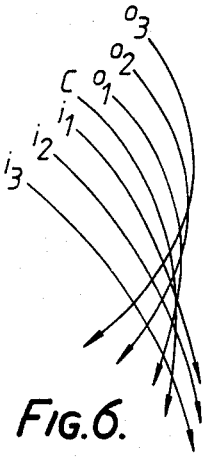
FIG. 6 is a diagram showing some electron trajectories at the detector site in an uncorrected electrostatic hemispherical energy analyzer.

The effect of the spread of initial directions of the trajectories from a monochromatic point source of electrons situated at the entrance to the hemispherical analyzer is illustrated in FIG. 6 which shows typical trajectories at the output of the hemispheres 1,2.

The traces which are based on a computer output of an uncorrected analyzer are marked according to the direction and angle with which they left the electron source. The $0_1$ indicates the trajectory next to the central trajectory but angled more towards the outer sphere whereas $i_3$ indicates that trajectory which is third nearest to the central trajectory and on the side nearest to the inner hemisphere at the start. C indicates the central trajectory, which contains the optical axis.

Figure 7:
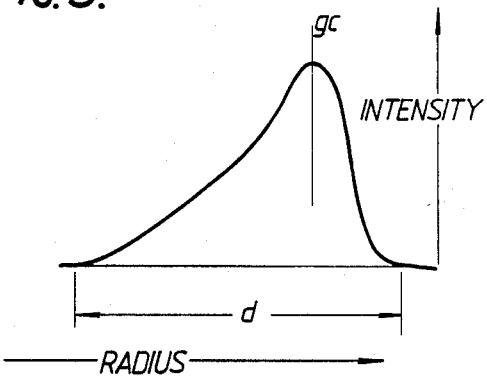
FIG. 7 is a diagram showing the intensity distribution of electrons across the detector plane of an uncorrected electrostatic hemispherical energy analyzer from a point source of monoenergetic electrons at the entrance to the analyzer.

Using trajectory plots such as those shown in FIG. 6 enables an intensity plot to be made of the aberrated image at the exit of the electrostatic hemispherical energy analyzer for a monochromatic point source at the entrance of the analyser, and such a plot is shown in FIG. 7. It will be seen that it is peaked approximately in the centre of the gap, gc, but that there is a marked assymetry, with a long tail on the side nearer to the inner hemisphere 1. The width of the distribution d is in accordance with expression 1.

Figure 8:
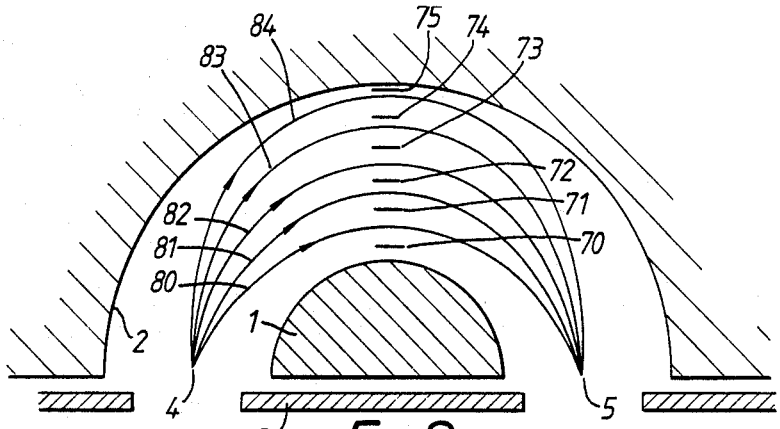
FIG. 8 is a diagram showing the action in an electrostatic hemispherical energy analyzer, of six equally spaced correctors or monochromatic electrons emitted from a point source at the entrance to the analyzer and brought to a focus at the exit of the analyzer.

FIG. 8 shows an electrostatic hemispherical electrostatic energy analyzer provided with six equally spaced corrector strips 70,71,72,73,74,75, in the gap between the hemispheres, and shows the five electron trajectories 80,81,82,83 and 84 which are at the centres of their respective portions of the beam. The potentials on the corrector strips are arranged so that the central beam portion is changed little as compared with an uncorrected system i.e. trajectory 82 is essentially the same as trajectory 60 in FIG. 5. The next outermost trajectory 83 will, in the absence of a correcting field, come to a focus nearer to the inner hemisphere. In order to make the trajectory 83 come nearer to trajectory 82 at the exit of the analyzer, the potential difference between correctors 73 and 74 is arranged to deflect trajectory 83 outwards. Similarly for the outermost trajectory shown i.e. 84 the correctors 74 and 75 are biassed to deflect the trajectory even more toward the outer hemisphere 2.

The first inner trajectory 81 from the central or median trajectory 82 under uncorrected conditions exits from the analyzer between the median trajectory 82 and the inner hemisphere 1. In fact it exits near to the first outer trajectory 83. By applying a suitable potential between correctors 71 and 72 the trajectory can be moved slightly away from the inner hemisphere 1, so that it is nearer to the median or central trajectory 82, at the exit of the analyzer. The trajectory 80, which passes even nearer to the inner hemisphere 1, is deflected in a similar manner by correctors 71 and 70.

When passing between two correctors a trajectory is influenced mainly by the potential applied between these correctors, but in the regions preceding and following the correctors the trajectory is also influenced by the potentials of the other correctors as well as by the potentials of the two hemispheres. Empirical methods, such as computing the final positions of the trajectories for various sets of values of the corrector potentials, must be used to determine the corrector potentials that will give the best convergence of the trajectories at the exit of the analyzer.

Typically potential values applied to the hemispheres and the correctors for an analyzer with a pass energy of 60 eV are given in the following table. The voltages given are referred to the electrons having zero kinetic energy.

| | Electrode | Radius (cms.) | Potential (Volts) |
|---|---|---|---|
| inner hemisphere | 1 | 20.0 | 120 |
| outer hemisphere | 2 | 40.0 | 30 |
| corrector | 70 | 22.0 | 71.2 |
| corrector | 71 | 25.2 | 75.7 |
| corrector | 72 | 28.4 | 62.0 |
| corrector | 73 | 31.6 | 51.5 |
| corrector | 74 | 34.8 | 38.0 |
| corrector | 75 | 38.0 | 29.9 |

Figure 9:
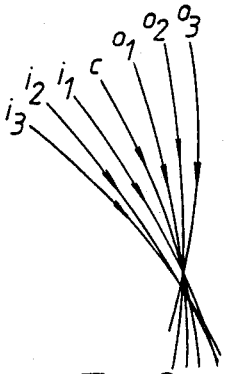
FIG. 9 is a diagram showing the electron trajectories at the exit of a corrected electrostatic hemispherical energy analyzer using six equally spaced correcting strips, the electrons emitted from a monochromatic point source at the entrance to the analyzer and brought to a sharper focus than in the uncorrected system of FIG. 5.

FIG. 9 shows the effect of a corrected electrostatic hemispherical energy analyzer on the trajectories at the exit of the analyzer, the trajectories originating from a monochromatic point electron source on the optical axis at the entrance to the analyzer. The improved focusing properties can be seen by comparison with FIG. 6 which shows the focusing properties for an uncorrected electrostatic hemispherical analyzer.

Figure 10A:
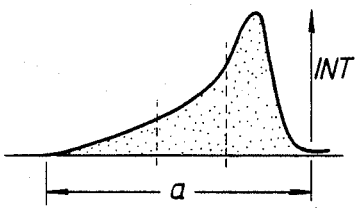
FIG. 10*a* is a curve showing the intensity distribution of electrons across the detector plane of an incorrected electrostatic hemispherical energy analyser when monochromatic electrons are emitted from a point source at the entrance to the analyzer.
Figure 10B:
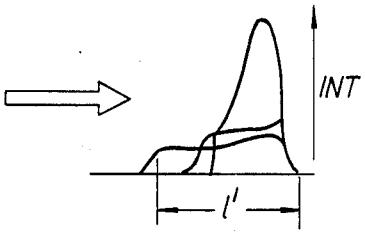
FIG. 10*b* shows the intensity distribution curve in a corresponding analyzer provided with six equally spaced correctors and illustrating the 'bunching' effect of the correctors.

As in the case of the uncorrected analyzer it is possible to utilize trajectories of the type shown in FIG. 9 to determine the intensity distribution of electrons across the exit plane of the corrected analyzer. FIG. 10*b* has been derived in this way for the case of the hemispherical electrostatic analyzer fitted with six equally spaced, suitably biassed, strip correctors. It is compared with FIG. 10*a* where the intensity distribution is shown with the correctors not in operation, the source input conditions being the same as for FIG. 10*b*. It will be seen that, with the correctors in operation, a significant 'bunching' of the intensity is observed which is equivalent to a reduction of the aberration of the analyzer.

Figure 11:
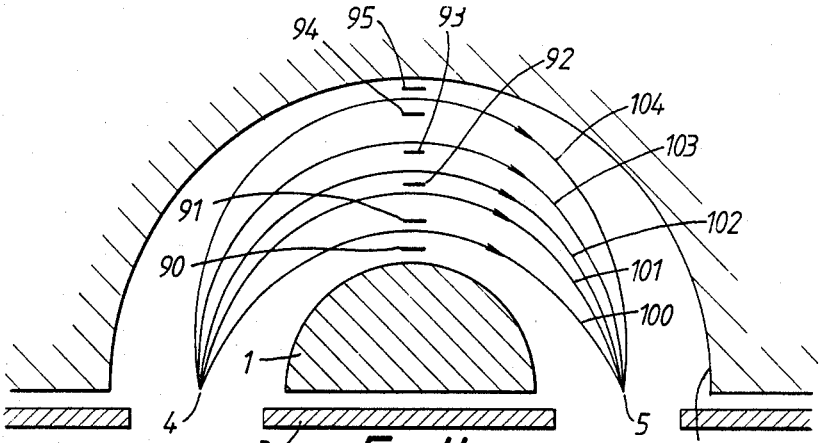
FIG. 11 is a cross section on the optical axis of an electrostatic hemispherical analyzer provided with six unequally spaced correctors.
Figure 12:
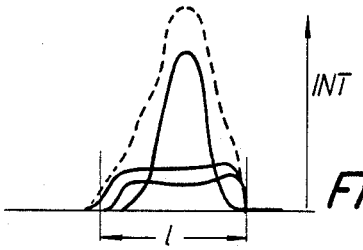
FIG. 12 is a curve showing the intensity distribution of electrons across the focus/exit of an electrostatic hemispherical energy analyzer fitted with six unequally spaced correctors, the source being a point source of monoenergetic electrons at the entrance to the analyzer.

It is not necessary for the correctors to be equally spaced between the hemispheres, indeed there are advantages in not having equally spaced analyzers in that the bunching shown in FIG. 10*b* can be done more effectively. FIG. 11 shows a hemispherical analyzer fitted with unequally spaced correctors, 90,91,92,93,94,95. The effect of bunching of the trajectories can be made so that the intensity profile is as shown in FIG. 12, where the bunching is more symmetric than in FIG. 10*b*. The dimension 1 is significantly less than the dimension a in FIG. 10*a*.

Figure 13:
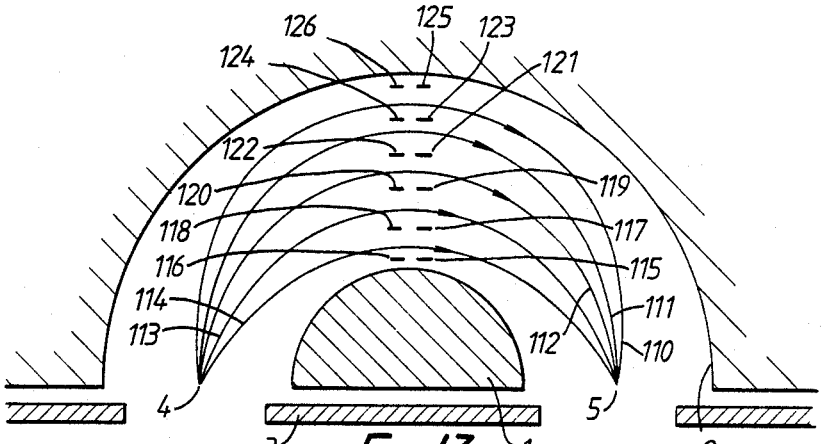
FIG. 13 is a cross section on the optical axis of an electrostatic hemispherical energy analyzer fitted with unequally spaced corrector strips arranged in pairs so that they can be biassed to operate with a planar lens action.

Yet a further refinement to the corrector system in the electrostatic hemispherical energy analyzer, is to provide a paired arrangement of correctors such as the six pairs 115;116 to 125;126, as shown in FIG. 13. The correctors of each pair are arranged one behind the other along the direction of the electron trajectories and the pairs can be used alone or with adjacent pairs as planar lenses. This gives added degrees of flexibility to the corrector system. The pairs of correctors, as shown, divide the beam into five main portions with central trajectories 110,111,112,113,114.

Figure 14:
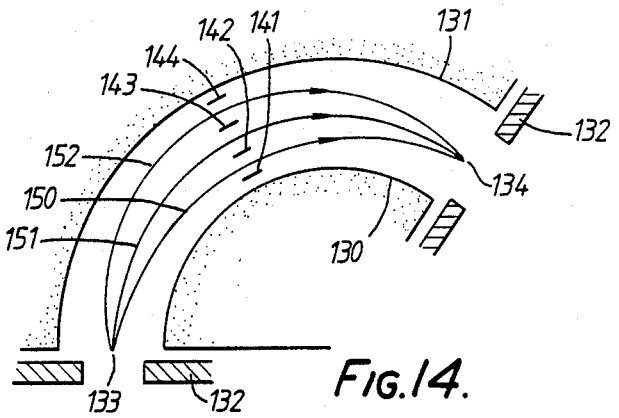
FIG. 14 is a section on the optical axis of an electrostatic cylindrical energy analyzer provided with four correctors.

The invention is not confined to the electrostatic hemispherical energy analyzer. It can be used in sections of a sphere other than 180°, while FIG. 14 shows the use of correctors in yet another form of electrostatic energy analyzer namely the cylindrical electrostatic energy analyzer. Further details of this, and other energy analyzers discussed herein, may be found in the article by E.H.A. Granneman and M J Van der Wiel in Handbook of Synchrotron Radiation Vol 1 pp 367–462, 1983, by E. E. Koch (North-Holland Publishing Co.) and also the paper by W Steckelmacher in J. Phys.E. Scientific Instruments Vol 6 p 1061 et seq., 1973.

Correctors can be readily provided in an electrostastic cylindrical energy analyzer because the device is essentially of two-dimensional symmetry. In figure 14 the analyzer comprises inner and outer part cylindrical electrodes 130,131 supported from a fringing plate 132. The correctors, 141,142,143,144 are simple straight strips, at right angles to the electron plane of FIG. 14, causing portions of the beam with central trajectories 150,151,152, from a point monochromatic source at 133 to come to a corrected focus at the exit 134.

Figure 15:
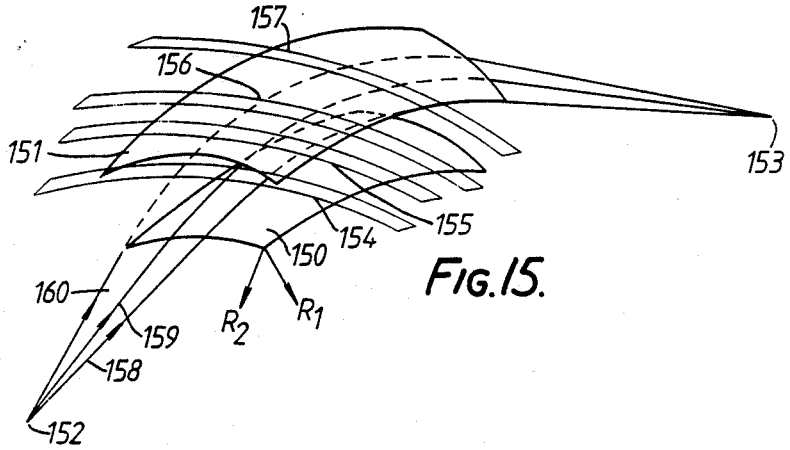
FIG. 15 is a sectioned view of part of an electrostatic energy analyzer of torroidal form and provided with four corrector plates.

FIG. 15 shows a torroidal electrostatic energy analyzer, which is similar to a hemispherical, or other sector of a sphere, analyzer but the radii of the curved electrode plates 150,151 are different at right-angles to each other. Thus the electrodes can have a radius of curvature R1 of 10 cm in one direction and a radius R2 of 12 cm in a direction at right angles to this. The charged particle beam passes from a point source 152 to a focus 153, and the correctors 154,155,156,157, which are spaced apart curved strips following arcs having radii concentric with radius $R_2$, divide the beam into portions with central trajectories 158,159,160.

Figure 16:
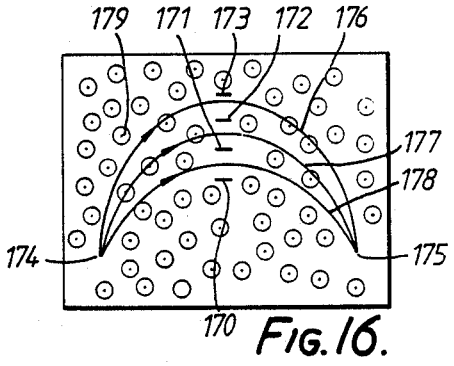
FIG. 16 is a section on the optical axis of a magnetic prism, which can be used for energy analysis or mass analysis depending on the source of charged particles, having four correctors disposed parallel to the magnetic field.

The invention is not restricted to electrostatic energy analyzers but can be applied to magnetic sectors which are used for energy and/or mass analysis. In FIG. 16 a magnetic sector of 180° deflection is shown, provided with four corrector strips 170,171,172,173 spaced apart across the charged particle beam passing from point source 174 to focus 175. The strips divide the beam into three main portions with central trajectories 176,177, and 178. Just as in the case of electrostatic energy analyzers, the trajectories on either side of the median trajectory are brought to a focus on the smaller radius side of the median trajectory. Under certain conditions this defect can be corrected by shaping the magnetic polepieces but an alternative approach is offered by the use of the correctors of the present invention as in FIG. 16.

Figure 17:
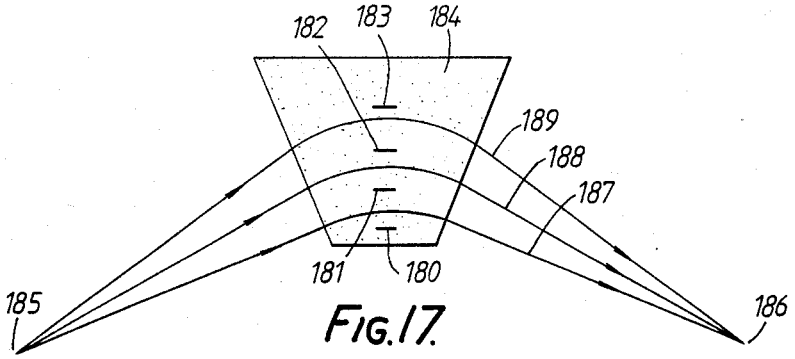
FIG. 17 is a section similar to that of FIG. 16 in which the magnetic prism is of truncated sector shape.

The correctors can be applied to magnetic sectors of deflection angle other than 180° and FIG. 17 shows the correctors applied to a magnetic sector with an angle of less than 90°. As shown, a beam from an source 185 passes through the magnetic sector 184 to a focus 186. Within the sector, four correctors 180–183 are spaced apart across the beam. The correctors divide the beam into three main portions with central trajectories 187,188,189.

Figure 18:
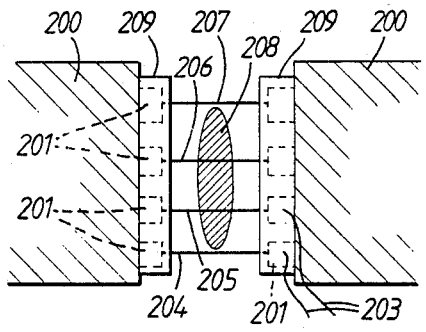
FIG. 18 is a section through the poles of a magnetic deflector energy system or mass analysis system provided with correctors.

The mounting of correctors between the polepieces of a magnetic sector is shown schematically in FIG. 18. This is an example, and other mounting methods may be adopted to suit particular requirements. In FIG. 18 the correctors 204,205,206,207 are strips supported between the polepieces 200, by means of suitable insulating supports 201, which are attached to the polepieces. The electrical potentials to the correctors are carried by suitable wires 203, which terminate at the supports 201. The particle beam bundle 208, is shown with respect to the correctors 204,205,206,207. In this arrangement the polepieces must be within the vacuum system of the apparatus. The beam bundle 208 is prevented from 'seeing' the insulating terminations of the correctors by a pair of conducting shields 209. Obviously the correctors, the supporting mechanism and the shields must be fabricated from non-magnetic material.

Figure 19:
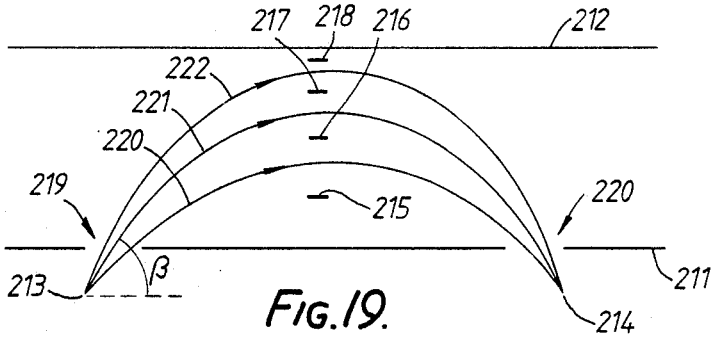
FIG. 19 is a section on the optical axis of an electrostatic energy analyzer of the parallel plate type provided with correctors.

Another electrostatic energy analyzer that can benefit from the use of aberration correctors is the parallel plate detector (see E.H.A. Granneman and M.J. van der Wiel (op.cit) and also W.Steckelmacher (op.cit)). Such an analyzer, as shown in FIG. 19, consists of two parallel plates 211,212 with slits 219,220 cut in the bottom plate to permit entry and exit of a charged particle beam. Suitable corrector strips, 215,216,217,218 are located between the parallel plates 211,212. A source 213 is placed below, and at an angle $\beta$ to the slit 219 and the beam is brought to a focus 214 corresponding at a detector below the exit slit 220. The corrector strips 215,216,217,218 and the slits 219,220 are at right angles to the section plane of the figure. There are certain geometries of the parallel plate analyzer which suffer from aberrations less than others e.g. when the angle of the beam to the plates $(\beta)=30°$ the device is second order focusing, the use of the corrector strips means that other geometries can be adopted without being too seriously affected by aberrations. Such other geometries can lead to more convenient configurations.

Figure 20:
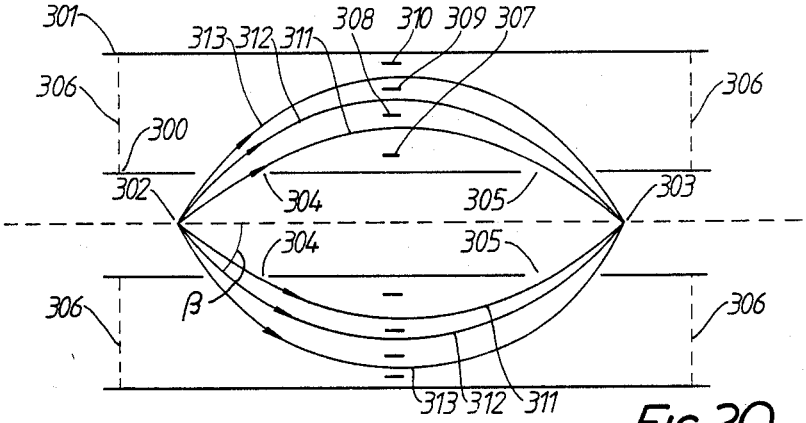
FIG. 20 is a section on the central axis of a cylindrical mirror analyzer provided with correctors, and since the strips cannot be held over 360° round the whole analyzer they are, in the example shown, applied to a 'half' cylindrical mirror analyzer (CMA) of the type designed by H. E. Bishop et al and described in the Journal of Electron Spectroscopy and Related Phenomena, Vol. 1, No. 4, pp 389–401, 1973.

FIG. 20 shows the three dimensional equivalent of the parallel plate analyser namely the cylindrical mirror analyzer. It consists of two co-axial cylinders, an inner 300, and an outer 301, the inner having annular slits 304,305 which are arranged at suitable angles to the object 302 and focus 303 respectively. The annular slits are segmented otherwise the inner cylinder between the slits would not be supportable. The field between the cylinders causes the trajectories 311,312,313 to be focused and the field at the end of the cylinders is terminated by suitable correctors 306. The device is described in Granneman and Van der Wiel (op.cit) as well as in Steckelmacher (op,cit). With an entrance angle $\beta$ of 42° the device is second order focusing but at other angles it is not so. Annular corrector strips (i.e. rings) 307,308,309,310 placed in the system as shown in FIG. 20 allow the system to be used at other angles without excessive aberrations. Obviously as the cylindrical mirror analyzer is essentially rotationally symmetric some modification will have to be made to it so that the corrector rings can be supported. Two possible modes of support are shown in FIGS. 21*a* and 21*b* respectively.

Figure 21A:
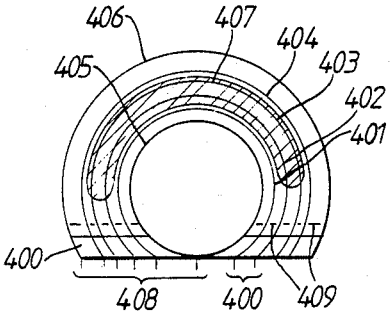
FIG. 21*a* and 21*b* are sections through cylindrical mirror analyzers (CMA) showing means for supporting corrector strips, FIG. 21*a* illustrating the half CMA of FIG. 20 and FIG. 21*b* showing means for shuttering off two small areas of a whole CMA.

FIG. 21*a* shows a cylindrical mirror analyzer whose electrodes comprise a complete inner cylinder 405 and an outer cylinder 406 which is not complete—such a system has been built and described by Bishop et al (op.cit)—and could be called a half-CMA since only half the system is used electron optically, as indicated by the beam cross-section 407. The half of the system not used electron optically is used to support an insulator 400 which carries part-annular correctors 401,402,403,404. Connections 408 to the correctors are made by conductors through the insulator. A screen 409 prevents the beam 407 from 'seeing' the insulator 400.

Figure 21B:
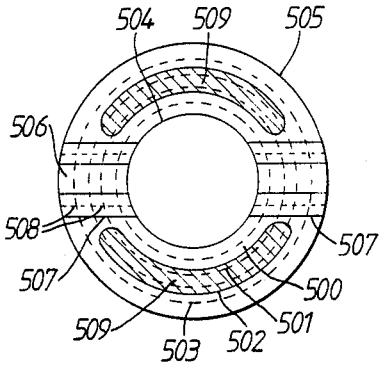

An alternative mode of supporting the correctors 500,501,502,503 is shown in FIG. 21*b* in which complete cylinders 504,505 are used. At two points, diagonally opposite each other and preferably, but not necessarily, corresponding with the mid points of the trajectories (see FIG. 20) insulators 506 are mounted between the inner cylinder 504 and outer cylinder 505. The insulators 506 support the correctors 500,501,502,503 at suitable spacings between the two cylinders. In order that the focusing field of the device shall not be upset by the supporting structure for the correctors, the actual supporting structure is shielded by a pair of high resistance guards 507 mounted in front of the supports as seen adjacent the beam envelope. The guards 507 are mounted between the inner and outer cylinders 504,505 and their resistance and shape is selected so that the equipotentials on the guards match exactly the potentials between the two cylinders. In this way no perturbation of the trajectories occurs.

As well as being capable of application to the correction and/or minimization of the aperture aberration of charged particle electrostatic energy analyzers and magnetic mass and energy analyzers of various types and geometries, the principle of the correcting strips can be applied to lenses in order to minimize the aperture defect of such lenses. (This defect is known as spherical aberration in the case of rotationally symmetric lenses and the name linear aberration coefficient has been used for planar lenses). A planar lens is understood to be one which has one or more planes of reflection symmetry that pass through its optical axis.

Figure 22:
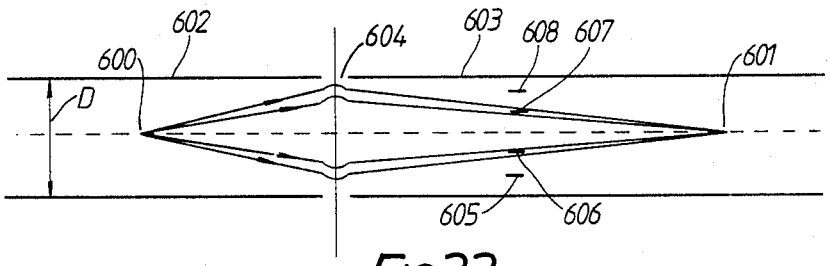
FIG. 22 is a section on the optical axis of one form of planar lens in which parallel electrodes and correctors extend normal to the section plane, the correctors being operative under certain conditions to reduce spherical or linear abberration.
Figure 23:
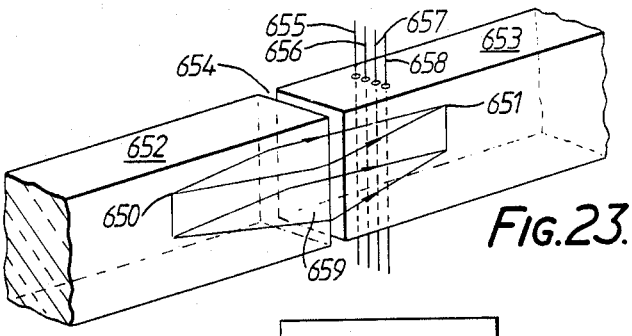
FIG. 23 is a perspective view of the lens of FIG. 22.

Planar lenses can be constructed with suitable correctors and an example of such a lens is shown in FIGS. 22 and 23. FIG. 22 shows a section through such a lens which comprises two sets of linear electrodes 602,603 spaced apart by a gap 604. The object or source 600 is immersed in the potential of the first lens element 602. Trajectories from the object or source 600 pass into the second lens element 603 after passing the lens gap 604. The second lens element 603 is held at a different potential to the first lens element 602. The field produced in the vicinity of the lens gap 604 causes a focusing action, whether the lens particles are accelerated or decelerated by the potentials on 602 and 603, and hence the trajectories come to a focus 601 in the second lens element. In order to correct the system for spherical or linear aberration strip correctors 605,606,607,608 are spaced apart across the particle beam parallel to the electrodes and arranged between the lens gap and the final focus as shown in figure 22.

In FIG. 22 the correctors have been shown between the lens gap 604 and the focus or image 601. Alternatively the correctors can be placed nearer to or within the lens gap.

FIG. 23 is a perspective view of a planar lens. It shows the rectangular section form of the electrodes 652,653 which are spaced apart by a gap 654, and the location of the straight correctors 655 to 658 which are parallel-spaced apart from each other across the beam and disposed parallel to one opposite pair of walls of the electrode 653. The beam path 659 passes across the gap from the source 650 within electrode 652 to the focus 651 within electrode 653. FIG. 23 also illustrates the line focusing properties of the lens.

Figure 24A:
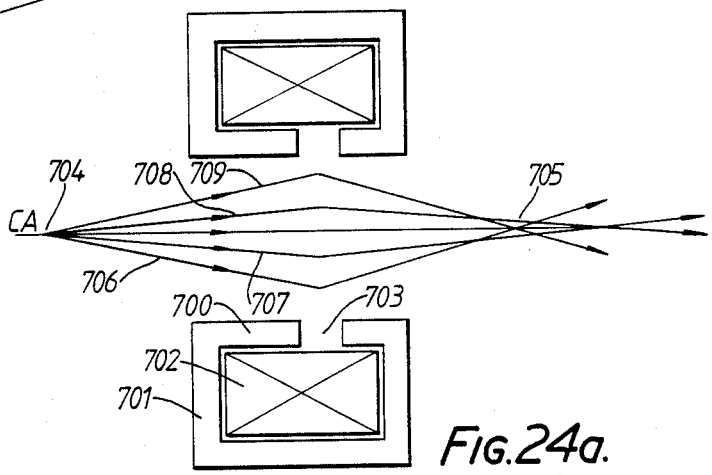
Figure 24B:
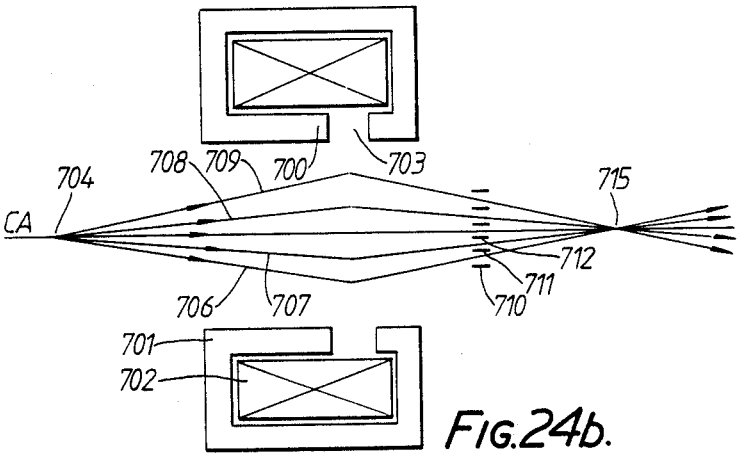
FIG. 24*b* shows the lens of FIG. 24*a* provided with a pair of circular strip correctors and illustrates the sharper focus achieved, the means for supporting the strip correctors being omitted.
Figure 24C:
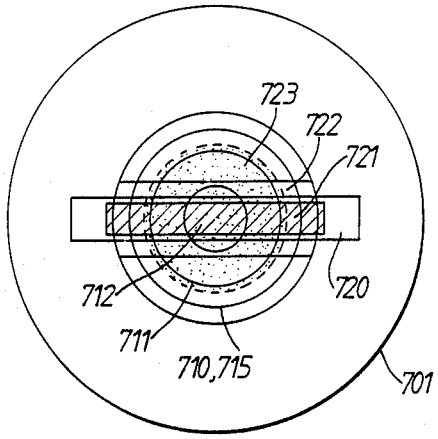
FIG. 24*c* is a section through the lens of FIG. 24*b* in a plane normal to axis and showing means for supporting the strip correctors.

FIGS. 24*a*,24*b* and 24*c* illustrate the use of correctors with a rotationally symmetrical magnetic lens. FIG. 24*a* shows a conventional magnetic lens of rotational symmetry consisting of polepieces 700, a magnetic return path 701 and an excitation coil 702 to energise the magnetic circuit and a gap 703 where most of the focusing action occurs. The central symmetric axis of the system is denoted by CA. It will be seen that the trajectories 706 to 709 from a point monochromatic on-axis source 704 are brought to a focus in the region 705. However because of the aperture defect, or spherical aberration as it is generally known in the context of rotationally symmetric lenses, the outer trajectories 706,709 come to a focus nearer to the object or source 704 along the central axis CA than the inner trajectories 707,708. This problem can be overcome by locating suitably biassed circular corrector strips 710 to 712 co-axially around the central axis CA as shown in FIG. 24*b*. In this case the correctors (which are shown in FIG. 24*b* without visible means of support for the sake of clarity) cause a sharper focus 715 to be obtained compared with that of FIG. 24*a*.

A method of mounting the circular corrector strips 710 to 712 is shown in FIG. 24*c*. In this figure the lens is viewed end on with the central axis perpendicular to the plane of the diagram. A nonmagnetic support plate 720 provided with a suitable insulator 721 is so located that it is supported by one side of the lens. The support plate 720 and insulator 721 in their turn support the corrector rings 710 to 712. An earthed shield 722 is placed in front of the support assembly to prevent charged particles from 'seeing' the insulator. A problem may arise in that there may be some interaction between the shield 722 and the corrector rings 710 to 712. This can be overcome by means of a suitable guard electrodes and fringe field correctors. The beam cross section is shown by 723.

Figure 25A:
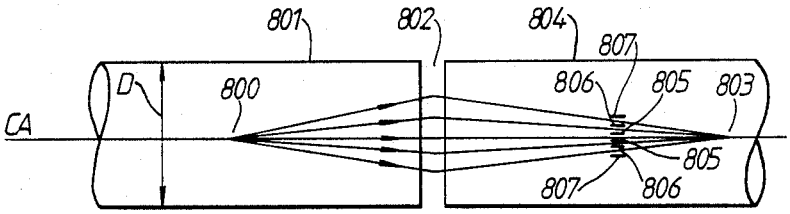
FIG. 25*a* is a section on the optical axis through a rotationally symmetrical bipotential electrostatic immersion lens provided with circular ring correctors for the partial correction of spherical aberration, the supporting means for the ring correctors being omitted.

By careful positioning of the correctors and the provision of shield electrodes, the same principle can be used in certain round or axially symmetric electrostatic lenses. For example the bipotential two electrode electrostatic lens suffers from spherical aberration in just the same way as the round magnetic lens described above. FIG. 25a shows a section through such an electrostatic round lens formed by cylindrical electrodes 801,804 spaced apart by a gap 802. A source 800 within electrode 801 emits a beam across gap 802 to a focus 803 within electrode 804. Annular correctors 805,806,807 co-axial are arranged in spaced apart relationship around the optical axis. The supports for the corrector rings are not shown for the sake of clarity. The source or object 800 which is considered to be a point source of monochromatic particles is held at a potential $V_1$. The trajectories having passed across the gap 802 between the two cylinders where most of the focusing action occurs, come to a focus 803 in the second cylinder 804 which is held at a potential $V_2$. $V_2$ may be greater or smaller than $V_1$ depending on whether an accelerating or decelerating system is required.

Figure 25B:
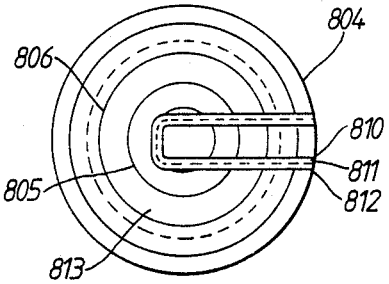
FIG. 25*b* is a section through the lens of FIG. 25*a* in a plane normal to the axis and showing means whereby the ring correctors can be mounted.

The method of mounting the correctors within the lens is shown in FIG. 25*b*. It is assumed that the correctors are mounted in a field free region, apart from the field generated by the correctors themselves, so that a main support 810 and shield electrode 812 can be maintained at the same potential as the cylinder in which they are contained. There may be some field distortion between the correctors, which are at a different potential to the shield potential $V_2$, thus making necessary an insulating mount 811 on the main support and some fringe field correcting system.

Figure 26A:
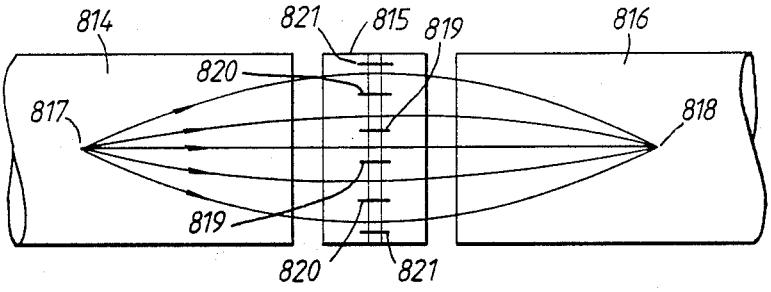
FIG. 26*a* is a section through the optical axis of a rotationally symmetric three-cylinder electrostatic lens provided with circular ring correctors for the partial correction of spherical aberration.

A different method of mounting the correctors must be used if the region on which they are situated is not field-free. FIG. 26*a* shows a section through an electrostatic round lens formed by spaced-apart cylindrical electrodes 814,815 and 816. A source 817 within electrode 814 emits a beam that is brought to a focus 818 within electrode 816. Annular correctors 819,820 and 821 are arranged in spaced-apart relationship around the optical axis, within electrode 815. The potentials of the electrodes 814,815 and 816 are in general different from each other and as a consequence the correctors are situated in a region of field.

Figure 26B:
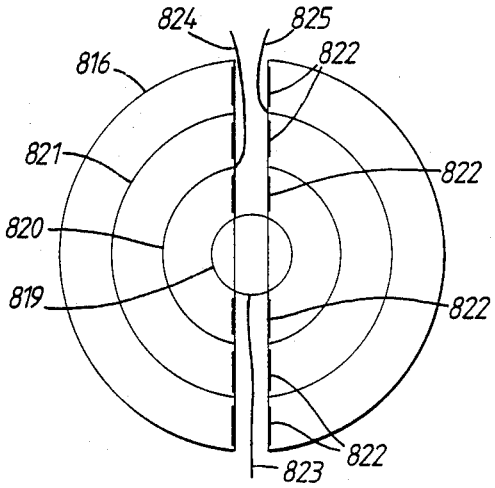
FIG. 26*b* is a section through the lens of FIG. 26*a* in a plane normal to the axis and showing means whereby the ring correctors can be mounted.

The method of mounting the correctors within the lens is shown in FIG. 26*b*, which is a section through the lens on a plane normal to the optical axis. The supports 822 maintain the correctors 819,820 and 821 in the required positions. These supports can be constructed of insulating material that is coated on the outside with a thin layer of conducting material, such as graphite. The insides of the supports are hollow, allowing passage of the wires 823,824 and 825 that carry the potentials that are applied to the correctors 819, 820 and 821 respectively.

In summary, it has been shown that a series of strip conductors held at suitable electric potentials can correct the on-axis aperture defect in a number of electron optical devices including energy and mass analysers as well as lenses. The same principal can be applied to other electron optical devices not described in detail above. The correctors would normally be mounted in such a way that they are insulated from each other and also in such a way that the fields due to their mountings do not disrupt the electron optical functioning of the device to which they are attached. Alternatively the correctors can be mounted on conducting or semi-conducting supports and in such a way that the fields due to the correctors and supports play an integral part in the electron optical functioning of the device. In addition all the systems have to be mounted in a vacuum environment. Because of the finite gap between the correctors such corrected devices will be more applicable to beam transport problems rather than imaging problems although the latter are not to be excluded.

We claim:

1. A charged particle optical system, such for example as an energy analyzer, a mass analyzer or a lens system, the system having means, on the optical axis of the system, defining a source of charged particles, means, on said optical axis, defining a desired image position, and means for defining the path of a beam of substantially monoenergetic particles from said source to said desired image position, the system being subject to the aberration in which the trajectories of the particles emitted from the source at relatively large angles to the axis are brought to a focus on the same axis nearer to or further from the source than the trajectories of particles emitted at relatively small angles to the axis, the system having a plurality of electrically-insulated corrector electrodes disposed in spaced-apart relationship across the said path of the beam thereby dividing the beam into separate portions and which electrodes, when suitably biassed, so deflect the beam portions as to cause the beam portions to intersect the optical axis at, or closer to, the desired image position, thereby reducing the aberration.

2. A charged particle optical system according to claim 1 wherein the corrector electrodes are situated in a substantially field-free region.

3. A charged particle optical system according to claim 1 further comprising conducting or semi-conducting supports on which the electrodes are mounted.

4. A charged particle optical system according to claim 1 wherein the electrodes are formed as strips which are disposed parallel to one another and spaced apart in a direction perpendicular to the optical axis.

5. A charged particle optical system according to claim 1 wherein the electrodes are formed as wires.

6. A charged particle optical system according to claim 1 wherein the electrodes are unequally spaced apart.

7. A charged particle optical system according to claim 1 wherein at least some of the electrodes are disposed in pairs, one electrode of each pair behind the other electrode of the same pair along the said trajectories, the two electrodes of each pair being electrically isolated so that, when suitably biased, they provide a focusing effect that further reduces the said aberration.

8. A charged particle optical system according to claim 1 having four, five or six said electrodes disposed across the beam of charged particles.

9. A charged particle optical system according to claim 1 wherein the beam-defining means are part-spherical electrodes of an electrostatic energy analyser and the corrector electrodes are arcuate and concentric with the beam-defining electrodes.

10. A charged particle optical system according to claim 1 wherein the beam-defining means are the at least part-cylindrical electrodes of a cylindrical or line symmetry electrostatic energy analyser of 127° or other deflection angle and the corrector electrodes are straight and parallel-spaced apart between the beam-defining electrodes.

11. A charged particle optical system according to claim 1 wherein the beam-defining means are the magnetic polepieces of a magnetic energy analyzer or mass analyzer and the corrector electrodes are straight and mounted between the magnetic polepieces at right angles to the charged particle optical axis and also at right angles to the faces of the polepieces.

12. A charged particle optical system according to claim 1 wherein the beam-defining means are a pair of plates of a parallel-plate electrostatic energy analyzer and the corrector electrodes are straight and mounted between the beam-defining electrodes parallel thereto at right angles to the charged particle optical axis.

13. A charged particle optical system according to claim 1 wherein the beam-defining means are the concentric cylinders of a cylindrical mirror energy analyzer and the corrector electrodes are arranged concentric with the analyzer cylinders.

14. A charged particle optical system according to claim 1 wherein the beam-defining means are the electrodes of a planar lens that has at least one plane of reflection symmetry that passes through its optical axis and the corrector electrodes are disposed in the path of the beam and have the same planar symmetries on the beam defining means.

15. A charged particle optical system according to claim 1 in which the beam-defining means are the poles of a magnetic lens of axial symmetry, or the electrodes of an electrostatic lens of axial symmetry, and the corrector electrodes are arranged to be concentric with the optical axis.

16. A method of sharpening the focus of a beam of monoenergetic charged particles emitted from a source in an energy analyzer, a mass analyzer or a lens system and brought to a focus on the optical axis of the system, the system being subject to the aberration in which the trajectories of the particles emitted from the source at relatively large angles to the axis are brought to a focus on the same axis either nearer to or further from the source than the trajectories of particles emitted at relatively small angles to the axis, the method comprising passing the beam through a plurality of electrodes spaced apart from one another transversely of the beam to split the beam into a plurality of transversely - spaced beam portions and applying different potentials, to respective electrodes to cause corresponding beam portions to be deflected in a sense to cause the beam portions to intersect the optical axis closer to the desired focus, thereby rendering the aberration.

* * * * *